US005792004A

United States Patent [19]

Nagamoto

[11] Patent Number: 5,792,004

[45] Date of Patent: Aug. 11, 1998

[54] IRON GOLF CLUB AND A METHOD FOR PRODUCING THE SAME

[75] Inventor: Itsushi Nagamoto, Hamamatsu, Japan

[73] Assignee: Yamaha Corporation, Japan

[21] Appl. No.: 596,940

[22] Filed: Feb. 5, 1996

[30] Foreign Application Priority Data

Feb. 3, 1995 [JP] Japan ..... 7-037793

[51] Int. Cl.[6] ..... A63B 53/04

[52] U.S. Cl. ..... 473/349; 473/350; 473/409

[58] Field of Search ..... 473/350, 349, 473/324, 329, 342, 409; 273/DIG. 7, DIG. 23

[56] References Cited

U.S. PATENT DOCUMENTS

| | | |
|---|---|---|
| 835,735 | 11/1906 | Robertson . |
| 1,139,985 | 5/1915 | Legh . |
| 2,908,502 | 10/1959 | Bradstreet . |
| 4,792,139 | 12/1988 | Nagasaki . |
| 4,793,616 | 12/1988 | Fernandez . |
| 4,951,953 | 8/1990 | Kim . |
| 5,207,427 | 5/1993 | Saeki . |
| 5,280,819 | 1/1994 | Newkirk . |
| 5,458,334 | 10/1995 | Sheldon . |
| 5,472,202 | 12/1995 | Yamanaka . |
| 5,531,444 | 7/1996 | Buettner . |

*Primary Examiner*—Sebastiano Passaniti
*Attorney, Agent, or Firm*—Ostrolenk, Faber, Gerb & Soffen, LLP

[57] ABSTRACT

In production of iron golf club from soft-iron material, surface hardening treatment typically such as cementation is applied at least locally to a main body to provide an irregular internal composition made up of a carbonized surface layer and a soft-iron core. Thanks to fortification via surface hardening treatment, a face on the main body can be reduced in wall thickness for reduction in total weight without any substantial degradation in endurance against mechanical shocks at shooting balls.

9 Claims, 2 Drawing Sheets

IRON GOLF CLUB AND A METHOD FOR PRODUCING THE SAME

BACKGROUND OF THE INVENTION

The present invention relates to an iron golf club and a method for producing the same, and more particularly relates to improvements in ball-shooting characteristics and the adjustment of an iron golf club made of soft-iron.

The term "cementation" used herein refers to a surface hardening treatment in which a low carbon steel block is placed in a confined environment containing carbon or productive of carbon at high temperatures and heated at a high temperature for a long period. As a result of heating, carbon deposited on the block surface permeates inwards via diffusion to form a carbonized surface layer containing about 0.9% of a carbon. After subsequent quenching, the block assumes a surface hardness from 800 to 850 (Vickers hardness) but its core remains in the form of low carbon steel, thereby exhibiting sufficient toughness.

In the case of one typical conventional iron golf club, its main body including a face and a neck are formed in one body via casting of stainless steel material. In another case, they are also formed in one body via forging of soft-iron material such as S20C and S25C of JIS. In accordance with the configuration of an iron golf club of respective types, the total weight of the golf club is set to a range from 230 to 310 gr.

When an iron golf club is made of stainless steel, the relatively high strength of the material allows a thin wall construction of the face and the golf club is highly resistant against generation of rust. Despite such merits, high rigidity of the material does not allow easy deformation at the neck and/or at the border between the main body and the neck of the golf club. As a consequence, no adjustment of its lie and loft angles can be practiced at the retailer or user phase.

When an iron golf club is made of soft-iron, adjustment of its lie and loft angles can be performed rather easily even at the retailer or user phase thanks to the relatively low strength of the material. In order to provide the golf club with a construction sufficiently durable against mechanical shocks at shooting balls, it is required to increase the wall thickness to a range from 4.0 to 6.0 mm and such increase in wall thickness inevitably leads to corresponding increase in total weight of the golf club which seriously mars its maneuverability at shooting balls.

SUMMARY OF THE INVENTION

It is the basic object of the present invention to produce an iron golf club which is highly durable against mechanical shocks at shooting balls without any increase in total weight.

It is another object of the present invention to produce an iron golf club which allows easy lie and loft angle adjustment at the retail or user phase.

It is a further object of the present invention to provide a compatible solution to the conventional requirements for a reduced total weight and for easy lie and loft angle adjustment of a golf club made of soft-iron.

In accordance with one aspect of the present invention an iron golf club is made up of a main body and a neck formed in one body with each other and provided with a face one the main body having a wall thickness in a range from 1.0 to 2.8 mm.

In accordance with another aspect of the present invention, a main body is shaped from a soft-iron material to have a face of a wall thickness in a range from 1.0 to 2.8, and the shaped main body is subjected at least locally to surface hardening treatment.

Preferably, the surface hardening treatment is applied to the face side of the main body.

Preferably, the surface hardening treatment is applied to the rear side of the main body.

DESCRIPTION OF THE PREFERRED EMBODIMENTS

Figure 1:
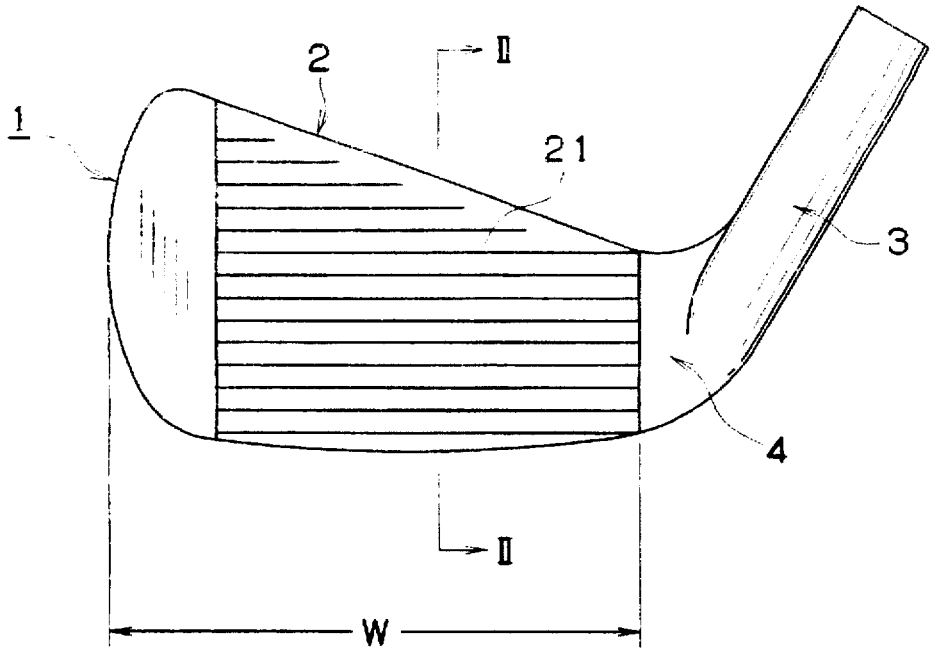
FIG. 1 is a front view of one embodiment of the iron golf club in accordance with the present invention.

One typical example of the an golf club to which the present invention is directed is shown in FIG. 1, in which a main body 1 of the iron golf club includes a head 2 connected in one body at a border 4 to a neck 3 receptive of a shaft not shown. The main body is made of soft-iron such as S20C and S25C (JIS) and a surface hardening treatment is applied to a specified area W which spans between the toe end of the main body 1 and the border 4.

Figure 2:
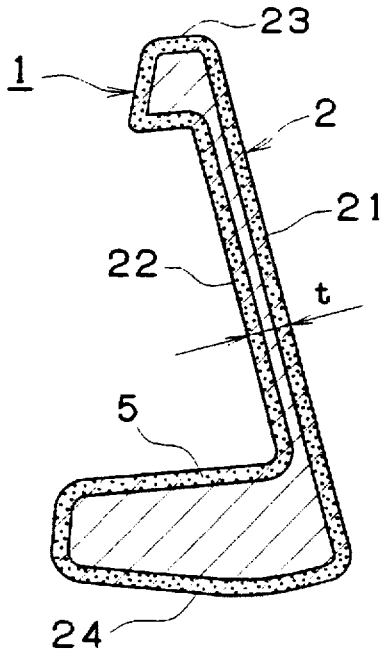
FIG. 2 is a sectional view taken along a line II—II in FIG. 1.

In the case of the embodiment shown in FIG. 2, the main body 1 is wholly covered, within the specified area W, by a hardened layer 5 which continuously extends from the top to the back 22 past the face 21 and the bottom 24 of the main body 1. The wall thickness t of the face 21 should be in a range from 1.0 to 2.8 mm, and more preferably in a range from 1.5 to 2.8 mm, and further preferably in a range from 2.0 to 2.8 mm.

The hardened layer 5 is formed by surface hardening treatment such as cementation applied to the specified area W and, as a consequence, the hardened layer 5 is given in the form of a carbonized surface layer. Since carbon permeates into the surface area of the main body 1 only, the core of the main body 1 remains in the form of low carbon steel even after the cementation. The main body 1 is thus provided with an irregular internal composition having a combination of a surface section of high rigidity with a core section of low rigidity.

Thanks to presence of the hard surface section, the golf club of the present invention well endures high grade of mechanical shocks at shooting balls. Limited permeation of carbon does not cause any substantial increase in total weight. Localized application of the hardening treatment excluding the neck 3 and the border 4 allows deformation of the golf club at these spots, thereby enabling easy adjustment of the lie and loft angles.

Figure 3:
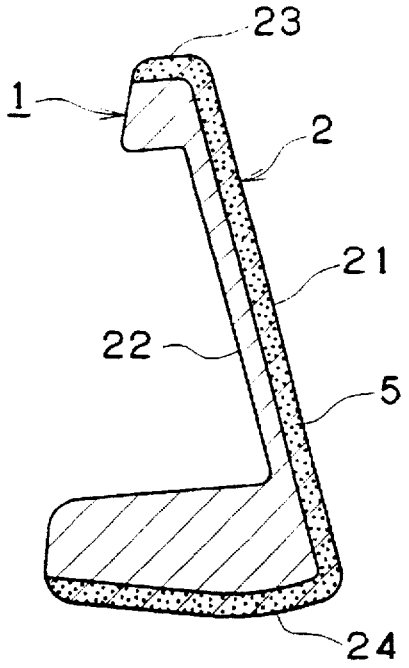
FIG. 3 is a sectional side view of another embodiment of the iron golf club in accordance with the present invention.
Figure 4:
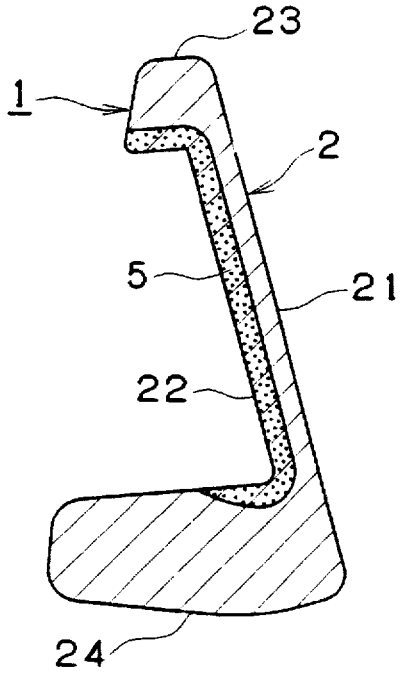
FIG. 4 is a sectional side view of the other embodiment of the iron golf club in accordance with the present invention.

In the case of the embodiment shown in FIG. 3, the localized hardening treatment is applied to the top 23, the face 21 and the bottom 24 of the main body 1 in the specified area W. Conversely, the localized hardening treatment may be applied to the back 22 of the main body 1 only as shown in FIG. 4.

As is well known, the face 21 and the back 22 are most exposed to direct mechanical shocks at shooting balls. So, for effective protection, the localized hardening treatment should cover at least to one of the face 21 and the back 22 of the main body 1 on one hand. On the other hand, however, the localized hardening treatment should exclude the neck 3 and border 4 of the main body 1 in order to enable easy deformation at these spots.

As stated above, the wall thickness "t" of the face 21 should be in a range from 1.0 to 2.8 mm. When the wall thickness fall short of this lower limit, the main body 1 cannot well endure mechanical shocks at shooting balls. Whereas, any wall thickness exceeding the higher limit would cause undesirable increase in total weight of the main body, thereby lowering maneuverability of the resultant golf club.

Formation of the carbonized surface layer at least at the face or at the back enables reduction in wall thickness of the face without degradation in its endurance against mechanical shocks at shooting balls. When compared with the conventional iron golf clubs of same types, the total weight can be reduced by about 20 to 30 g.

In addition, the high rigidity enables the face to act as a type of high tenacity spring at shooting balls and enhanced repulsion characteristics causes significant increase in flying distance of balls and preferable improvement in users' feel.

Further, highly fortified construction of the face raises its resistance against abrasion in use and assures a longer life of the indented configuration of the face.

When the total weight of the golf club is designed same as that of a conventional golf club of the same type, the mass saved by reduction in wall thickness can be allocated to other sections of the main body. Thank to such free mass allocation, the position of the center of gravity of the main body and/or the size of the sweet spot and be adjusted quite freely in accordance with users' preference.

I claim:

1. An iron golf club made of soft-iron material and including a main body comprising:

a carbonized layer formed by cementation and present at least locally in a surface region of said main body.

2. An iron golf club as claimed in claim 1 in which said carbonized surface layer is present in at least a face on said main body.

3. An iron golf club as claimed in claim 1 in which said carbonized surface layer covers at least a back on said main body corresponding to said face.

4. An iron golf club as claimed in claim 2, in which said face has a wall thickness in a range from 1.0 to 2.8 mm.

5. A method for producing an iron golf club, comprising the steps of:

(a) shaping soft-iron material into a main body, and (b) forming a carbonized layer by a cementation process at least locally in a surface region of said main body.

6. A method as claimed in claim 5 in which step (b) is carried out via cementation.

7. A method as claimed in claim 5 in which step (b) is applied at least to a face on said main body.

8. A method as claimed in claim 5 in which step (b) is applied at least to a back on said main body corresponding to said face.

9. A method as claimed in claim 7, in which said face has a wall thickness in a range from 1.0 to 2.8 mm.

* * * * *